US008071492B2

(12) United States Patent
Hess et al.

(10) Patent No.: US 8,071,492 B2
(45) **Date of Patent: *Dec. 6, 2011**

(54) TEXTILE FABRIC FOR THE OUTER SHELL OF A FIREFIGHTER'S GARMENT

(75) Inventors: Diane B. Hess, Gastonia, NC (US); Charles A. Thomas, Pearesbury, VA (US); Clifton A. Perry, Charlotte, NC (US); Richard O. Tucker, Oakboro, NC (US)

(73) Assignee: PBI Performance Products, Inc., Charlotte, NC (US)

( * ) Notice: Subject to any disclaimer, the term of this patent is extended or adjusted under 35 U.S.C. 154(b) by 1690 days.

This patent is subject to a terminal disclaimer.

(21) Appl. No.: 10/348,101

(22) Filed: Jan. 21, 2003

(65) Prior Publication Data

US 2003/0203690 A1 Oct. 30, 2003

Related U.S. Application Data

(63) Continuation-in-part of application No. 09/933,301, filed on Aug. 20, 2001, now Pat. No. 6,624,096.

(51) Int. Cl.

| | |
|---|---|
| ***D03D 15/12*** | (2006.01) |
| ***D03D 15/00*** | (2006.01) |
| ***D03D 13/00*** | (2006.01) |
| ***D02G 3/04*** | (2006.01) |

(52) U.S. Cl. ..... 442/302; 442/181; 442/203; 442/217; 428/920; 428/921; 57/252

(58) Field of Classification Search ..... 428/920, 428/921, 364, 365, 373, 377; 442/301, 181, 442/189, 203, 208, 217, 197, 199, 302; 57/238, 57/244, 252

See application file for complete search history.

(56) References Cited

U.S. PATENT DOCUMENTS

| | | | | |
|---|---|---|---|---|
| 2,619,705 | A | 12/1952 | Boutwell | |
| 3,347,969 | A | 10/1967 | Moelter | |
| 3,511,747 | A | 5/1970 | Davies | |
| 3,949,111 | A | 4/1976 | Pelletier | |
| 4,048,139 | A | 9/1977 | Calundann et al. | |
| 4,198,494 | A * | 4/1980 | Burckel | 525/432 |
| 4,219,996 | A | 9/1980 | Edgawa et al. | |

(Continued)

FOREIGN PATENT DOCUMENTS

CA 2313995 A1 7/2000

(Continued)

OTHER PUBLICATIONS

Definition of "Polybenzimidazole Fiber (PBI)," Dictionary of Fiber & Textile Technology, Published by Hoechst Celanese, 1990, pp. 116-116.

(Continued)

*Primary Examiner* — Angela Ortiz
*Assistant Examiner* — Jennifer Steele
(74) *Attorney, Agent, or Firm* — Hammer & Associates, P.C.

(57) ABSTRACT

The present invention is directed to a textile fabric. This fabric is particularly well suited for use as the outer shell fabric of a firefighter's garment. The fabric is a woven or knitted fabric of spun yarns and multi-filament yarns. The spun yarn includes a first staple being a polymer selected from the group consisting of aramid, PBI or PBO or melamine formaldehyde, and a second staple being an aramid polymer. The multi-filament yarn includes an aramid filament.

4 Claims, 1 Drawing Sheet

U.S. PATENT DOCUMENTS

| | | | | |
|---|---|---|---|---|
| 4,469,744 | A | | 9/1984 | Grot et al. |
| 4,470,251 | A | | 9/1984 | Bettcher |
| 4,500,593 | A | | 2/1985 | Weber |
| 4,602,385 | A | | 7/1986 | Warren |
| 4,748,065 | A | | 5/1988 | Tanikella |
| 4,750,443 | A | | 6/1988 | Blaustein et al. |
| 4,865,906 | A | | 9/1989 | Smith, Jr. |
| 4,900,613 | A | | 2/1990 | Green |
| 4,923,741 | A | | 5/1990 | Kosmo et al. |
| 4,931,345 | A | | 6/1990 | Böttger et al. |
| 4,941,884 | A | | 7/1990 | Green |
| 4,958,485 | A | | 9/1990 | Montgomery et al. |
| 4,967,548 | A | | 11/1990 | Fangeat et al. |
| 4,996,099 | A | | 2/1991 | Cooke et al. |
| 5,095,549 | A | | 3/1992 | Aldridge |
| 5,119,512 | A | | 6/1992 | Dunbar et al. |
| 5,120,599 | A | | 6/1992 | Lewis |
| 5,136,723 | A | | 8/1992 | Aldridge et al. |
| 5,177,948 | A | | 1/1993 | Kolmes et al. |
| 5,202,086 | A | | 4/1993 | Baliga et al. |
| 5,215,795 | A | | 6/1993 | Matsumoto et al. |
| 5,233,821 | A | * | 8/1993 | Weber et al. ..... 57/224 |
| 5,299,602 | A | * | 4/1994 | Barbeau et al. ..... 139/420 A |
| 5,323,815 | A | | 6/1994 | Barbeau et al. |
| 5,344,698 | A | | 9/1994 | Rock et al. |
| 5,447,787 | A | | 9/1995 | Shaffer |
| 5,482,763 | A | * | 1/1996 | Shaffer ..... 442/214 |
| 5,499,663 | A | | 3/1996 | Barbeau et al. |
| 5,538,781 | A | | 7/1996 | Rao et al. |
| 5,560,990 | A | | 10/1996 | Ilg et al. |
| 5,624,738 | A | | 4/1997 | Barbeau et al. |
| 5,628,065 | A | | 5/1997 | Austin |
| 5,637,114 | A | | 6/1997 | Höhnke |
| 5,654,067 | A | | 8/1997 | Dinger et al. |
| 5,688,594 | A | | 11/1997 | Lichscheidt et al. |
| 5,691,040 | A | | 11/1997 | Barbeau et al. |
| 5,701,606 | A | | 12/1997 | Aldridge |
| 5,858,888 | A | | 1/1999 | Underwood et al. |
| 5,882,791 | A | | 3/1999 | van der Werff et al. |
| 5,926,842 | A | | 7/1999 | Price et al. |
| 5,928,971 | A | * | 7/1999 | Ellis et al. ..... 442/76 |
| 5,962,627 | A | | 10/1999 | van der Werff et al. |
| 5,983,409 | A | | 11/1999 | Aldridge et al. |
| 5,996,122 | A | | 12/1999 | Aldridge et al. |
| 6,038,700 | A | | 3/2000 | Aldridge et al. |
| 6,065,153 | A | | 5/2000 | Underwood et al. |
| 6,192,520 | B1 | * | 2/2001 | Underwood et al. ..... 2/93 |
| 6,211,099 | B1 | | 4/2001 | Hutto, Jr. et al. |
| 6,247,179 | B1 | | 6/2001 | Underwood et al. |
| 6,559,079 | B1 | | 5/2003 | Bachner, Jr. |
| 6,562,741 | B1 | * | 5/2003 | Lilani ..... 442/301 |
| 6,624,096 | B2 | * | 9/2003 | Thomas et al. ..... 442/181 |
| 6,699,802 | B1 | | 3/2004 | Hainsworth et al. |
| 6,840,288 | B2 | | 1/2005 | Zhu et al. |
| 6,974,785 | B1 | | 12/2005 | Barbeau et al. |
| 2001/0009832 | A1 | | 7/2001 | Shaffer et al. |
| 2002/0034905 | A1 | | 3/2002 | Truesdale |
| 2002/0124544 | A1 | * | 9/2002 | Land et al. ..... 57/5 |

FOREIGN PATENT DOCUMENTS

| | | | |
|---|---|---|---|
| CH | 681600 | A5 | 4/1993 |
| DE | 4229546 | A1 | 3/1994 |
| EP | 0599587 | A1 | 6/1994 |
| FR | 2649128 | | 1/1991 |
| GB | 2070077 | A | 9/1981 |
| JP | 1272836 | | 10/1989 |
| JP | 2191760 | | 7/1990 |
| JP | 2264030 | | 10/1990 |
| JP | 4024240 | | 1/1992 |
| JP | 5125637 | | 5/1993 |
| JP | 6220730 | | 8/1994 |
| JP | 6226900 | | 8/1994 |
| JP | 7048754 | | 2/1995 |
| JP | 7292534 | | 11/1995 |
| JP | 8109530 | | 4/1996 |
| JP | 8246287 | | 9/1996 |
| JP | 9226031 | | 9/1996 |
| JP | 9078379 | | 3/1997 |
| JP | 9119038 | | 5/1997 |
| JP | 10130990 | | 5/1998 |
| JP | 11279894 | | 10/1999 |
| JP | 2000008247 | | 1/2000 |
| JP | 2000045147 | | 2/2000 |
| JP | 2000234236 | | 8/2000 |
| JP | 2000256927 | | 9/2000 |
| JP | 2000273742 | | 10/2000 |
| JP | 2000303285 | | 10/2000 |
| JP | 2000303289 | | 10/2000 |
| RU | 2127536 | C1 | 3/1999 |
| WO | WO 00/66823 | | 11/2000 |
| WO | WO 00/75410 | A1 | 12/2000 |

OTHER PUBLICATIONS

Definition of "Polybenzimidazole Fiber (PBI)", *Dictionary of Fiber & Textile Technology*, Published by Hoechst Celanese, 1990, pp. 115-116.

"abrade; abrasion," The Random House College Dictionary Revised Edition, The Random House, Inc. (New York), (p. 4,5), (1980).

"Abrasion Resistance," Dictionary of Fiber & Textile Technology, KoSa (Charlotte, NC), (p. 1), (1999).

"tear," The Random House College Dictionary Revised Edition, Random House, Inc. (New York), (p. 1348), (1980).

"Tear Strength," Dictionary of Fiber & Textile Technology, KoSa (Charlotte, NC), (p. 193), (1999).

Ernest R. Kaswell, "Cover, Copyright pages," Wellington Sears Handbook of Industrial Textiles, Wellington Sears Company, Inc. (New York, NY), p. 154-159, (1963).

Dictionary of Fiber & Textile Technology, Kosa, Charlotte, NC (1999) pp. 42, 44, 184.

NFPA 1971 (2007 Edition), NFPA, 1 Battery Park, Quincy, MA, pp. 1971-33 & 1971-56.

ASTM D1424-96—Standard Test Method for Tearing Strength of Fabrics by Falling Pendulum Type (Elmendorf) Apparatus, ASTM, 100 Bar Harbor Drive, West Conshohocken, PA, 1996.

ASTM D5587-05—Standard Test Method for Tearing Strength of Fabrics by Trapezoid Procedure, ASTM, 100 Barr Harbor Drive, West Conshohocken, PA, 2005.

Re-exam Serial No. 90/008132, Amendment filed May 9, 2007.

* cited by examiner

TEXTILE FABRIC FOR THE OUTER SHELL OF A FIREFIGHTER'S GARMENT

RELATED APPLICATION

The instant application is a continuation-in-part of U.S. patent application Ser. No. 09/933,301 filed Aug. 20, 2001 now U.S. Pat. No. 6,624,096.

FIELD OF THE INVENTION

The present invention is directed to a textile fabric for use as the outer shell fabric of a firefighter's garment.

BACKGROUND OF THE INVENTION

The outer shell fabric of a firefighter's garment must be flame, heat, abrasion, tear, and moisture resistant, durable, and lightweight. This outer shell fabric provides the first layer of protection for the firefighter.

U.S. Pat. Nos. 5,095,549; 5,136,723; 5,701,606; 5,983,409; 5,996,122; and 6,038,700 disclose, among other things, firefighter's garments having an outer shell fabric made of PBI/aramid fibers.

U.S. Pat. No. 5,299,602 discloses a woven, outer shell fabric made for firefighter's garments where the warp yarns are multi-filament aramid yarns and the weft yarns are either multi-filament or spun aramid yarns.

U.S. Pat. No. 5,628,065 discloses a firefighter's hood of a knit fabric formed of a blend of PBI and aramid fibers.

U.S. Pat. Nos. 6,065,153 and 6,192,520 disclose a woven outer shell fabric for a firefighter's garments. This fabric has a plain, twill or rip stop weave and the yarns are a mixture of PBI and aramid fibers. The fabric has a weight ranging from 5.5 to 8 OSY, preferably, 7.5 OSY.

One popular outer shell fabric is a woven fabric of spun yarns consisting of PBI and aramid staple. This fabric is known in the market as 'PBI GOLD®.' In the U.S., this fabric generally is made in the following forms: 1) a 7.5 OSY rip stop weave made from a 16/2 c.c. spun yarns consisting of 40% by weight PBI and 60% by weight of a para-aramid; or 2) a nominal 7.0 OSY (actual 7.3 to 7.4 OSY) rip stop weave made from a 21/2 c.c. spun yarns consisting of 40% PBI and 60% of the para-aramid. Internationally, this fabric is in the form of a 6.0 to 6.5 OSY rip stop weave 24-25/2 c.c. spun yarns of 40% PBI and 60% para-aramid, or a twill weave made from 35/2 c.c. spun yarns of 40% PBI and 60% para-aramid.

Another fabric used as an outer shell fabric is marketed under the trade name 'Millenia' from Southern Mills, Inc. of Union City, Ga. The Millenia fabric is made with a spun yarn consisting of 40% PBO and 60% para-aramid staple.

While 'PBI GOLD®' has proven to be an excellent outer shell fabric, there is still a need to improve these fabrics. There is a desire to have lighter weight fabrics that have better tear and abrasion resistance.

SUMMARY OF THE INVENTION

The present invention is directed to a textile fabric. This fabric is preferably used as the outer shell fabric of a firefighter's garment. The fabric is a woven or knitted fabric of spun yarns and multi-filament yarns. The spun yarn includes a first staple being a polymer selected from the group consisting of aramid or PBI or PBO or melamine formaldehyde, and a second staple being an aramid polymer. The multi-filament yarn includes an aramid filament.

DESCRIPTION OF THE DRAWINGS

For the purpose of illustrating the invention, there is shown in the drawings a form of the invention; it being understood, however, that this invention is not limited to the precise arrangements and instrumentality shown.

DESCRIPTION OF THE INVENTION

Figure 1:
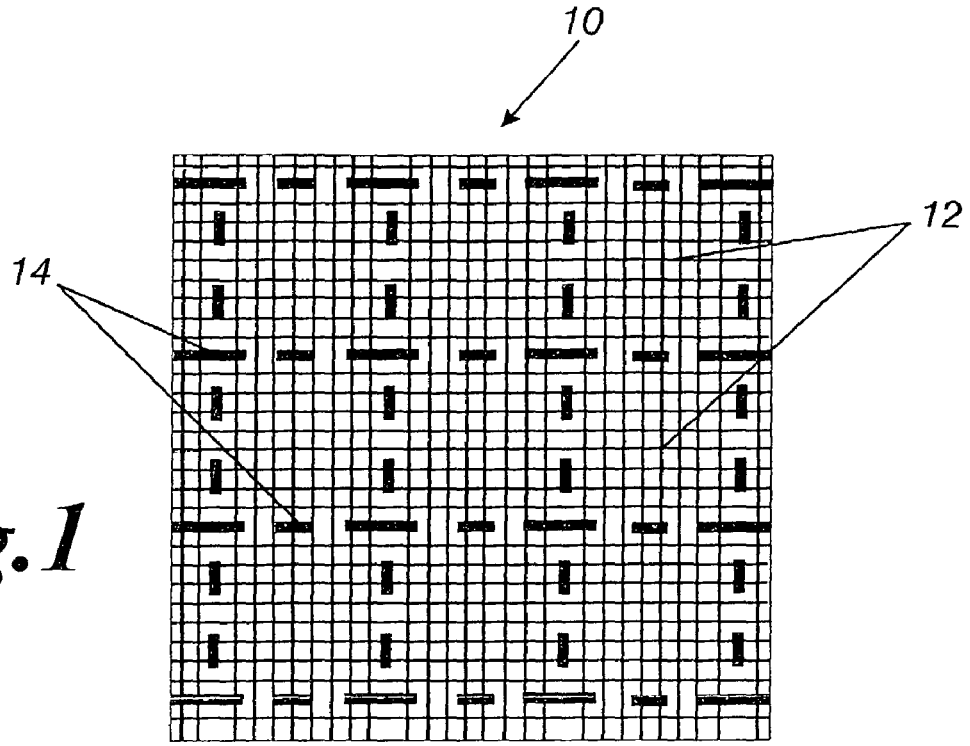
FIG. 1 is a plan view of the textile fabric made according to the present invention.
Figure 2:
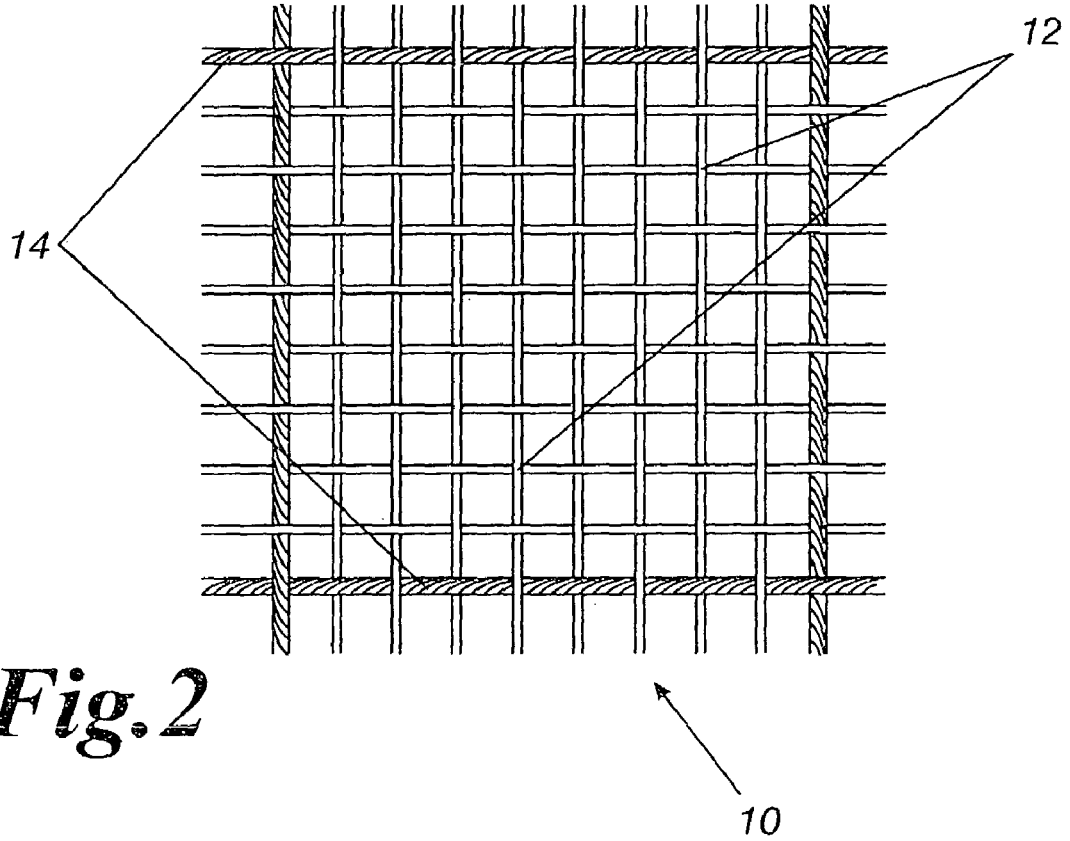
FIG. 2 is a magnified plan view of the textile fabric made according to the present invention.

Referring to the drawings wherein like numerals indicate like elements there is shown in FIG. 1 an illustration of the textile fabric 10 made according to the present invention. Preferably, the fabric 10 has a gold color with a 'checkered' pattern created by black multi-filament yarns 14. The fabric 10 may be woven or knitted. The fabric 10 is preferably woven with spun yarns 12 and multi-filament yarns 14. The weaves are selected from the group consisting of plain, twill, rip stop, and oxford. The fabric weight may range from 6 to 8 OSY, preferably, 7 OSY. The weight ratio of spun yarns to multi-filament yarns should range from 85:15 to 92:8, preferably, 90:10. The multi-filament yarn may be inserted among the spun yarns, in both the warp and weft, at an insertion ratio of 1:5 to 1:20, preferably, 1:9. Preferably, the fabric is treated with a water/moisture resistant finish, as is well known.

The spun yarns 12 are a blend of a first staple and a second staple. The first staple is fiber made from a polymer selected from the group of aramid, PBI, PBO, melamine formaldehyde, or combinations thereof. The second staple is a fiber made from an aramid or blends of aramids. Exemplary spun yarns include, but are not limited to, blends of aramid staple, PBI and aramid staple, PBO and aramid staple, melamine formaldehyde and aramid staple, and PBI, PBO, melamine formaldehyde and aramid staple. The spun yarns may have any weight ratio of first and second staples. The weight ratio of first and second staple is preferably 20-60% by weight first staple and 40-80% by weight second staple. The spun yarns most preferably comprise 30-45% by weight of the first staple and 55-70% by weight of the aramid staple. The spun yarns may range in size from 32/2 to 16/2 c.c., preferably, 24/2 c.c.

PBI staple fibers are commercially available from Celanese Acetate LLC of Charlotte, N.C. PBO staple fibers are commercially available under the trade name of ZYLON® from Toyobo Co., Ltd. of Osaka, Japan. Melamine formaldehyde fibers are commercially available under the trade name of BASOFIL® from BASF Corporation of Mount Olive, N.J.

The aramid staple fibers may be either a meta-aramid or a para-aramid. Such aramid fibers are commercially available under the trade name of TWARON®, CONEX®, and TECHNORA® from Teijin Co. of Osaka, Japan; or NOMEX® or KELVAR® from DuPont of Wilmington, Del.; or P84 from Lenzing AG of Lenzing, Austria; or KERMEL® from Rhodia Inc. of Cranbury, N.J. When the aramid staple fiber forms the second staple mentioned above, it may be either meta-aramid or para-aramid. When the aramid staple fiber forms the second staple mentioned above, it is preferably the para-aramid.

The multi-filament yarn is made from aramid filament. Aramid may be either meta-aramid or para-aramid, the para-aramid is preferred. Such aramid fibers are commercially available under the trade name of TECHNORA®, TWARON®, and CONEX® from Teijin Co. of Osaka, Japan, or NOMEX® or KELVAR® from DuPont of Wilmington, Del., or P84 from Lenzing AG of Lenzing, Austria or KERMEL® from Rhodia Inc. of Cranbury, N.J. The multi-filament yarn ranges in size from 200 to 1500 denier, preferably, 400 denier. The multi-filament yarn may be a flat yarn, a twisted yarn, or a stretch broken yarn.

The instant invention has superior tear and abrasion resistance, at a lower weight, over the PBI GOLD® fabric. The results are set forth in Table 1.

Fabric A is 6.0 OSY fabric; spun yarn is 27/2 c.c. with 45 percent weight PBI and 55 percent Technora® staple; multi-filament is a flat yarn inserted every $10^{th}$ yarn in the warp and weft.

Fabric B is 6.9 OSY fabric; spun yarn is 24/2 c.c. with 45 percent weight PBI and 55 percent Twaron® microdenier staple; multi-filament is a twisted yarn inserted every $9^{th}$ yarn in the warp and weft.

TABLE 1

| Performance Characteristic | Test Method | PBI Gold | Invention A | Invention B |
|---|---|---|---|---|
| Weight (OSY) | | 7.5 | 6.0 | 6.8-7.0 |
| Trap Tear (lbs.) | ASTM D5733 (Trapezoida 1 Method) | 40 × 35 | 75 × 75 | 63 × 63 |
| Tabor abrasion | ASTM D-3884 (500 g wt. With H18 abrasion wheel) | 225 | 180 | 293 |
| Thermal Protective Performance, TPP (Composite) | NFPA 1971 (2000 Edition Section 6.10) | 40 | 40 | 40 |
| Trap Tear after UV | AATCC 16 E (Standard Method for Xenon arc exposure at 1.1 rad) | | | |
| 60 hr | | 28.4 × 18.7 | 44.6 × 38.5 | |
| 180 hr | | 17.8 × 12.3 | 25.7 × 18.9 | |
| 300 hr | | 15.2 × 10.6 | 21.2 × 16.1 | |
| Trap Tear after Sunlight | ASTM D5733 (Trapezoid Method) | | | |
| 1 week | | 30.8 × 20.8 | 64.9 × 62.7 | |
| 2 week | | 24.3 × 17.0 | 45.5 × 40.1 | |
| 3 week | | 20.0 × 14.6 | 39.0 × 34.2 | |
| 4 week | | 18.8 × 13.1 | 34.0 × 33.9 | |
| 5 week | | 16.6 × 13.5 | 29.7 × 30.1 | |
| 6 week | | 14.8 × 10.5 | 26.6 × 23.6 | |

The present invention made be embodied in other forms without departing from the spirit and the central attributes thereof and, accordingly, reference should be made to the appended claims, rather than to the foregoing specification, as indicated the scope of the invention.

The invention claimed is:

1. An outer shell fabric for firefighter's turnout gear comprising:

a woven fabric including spun yarns and filament yarns, said spun yarn consisting of 30-45 weight % of a first staple of a polymer selected from the group consisting of PBI or PBO, and a second staple of an aramid polymer, and a weight ratio of said spun yarn to said filament yarn in the range of 85:15 to 92:8, said woven fabric having a greater trap tear when compared to a fabric of equivalent weight without said filament and a greater tabor abrasion when compared to the fabric of equivalent weight without said filament.

2. The fabric of claim 1 wherein the weight ratio is 90:10.

3. The fabric of claim 1 wherein the woven fabric has a weave selected from the group consisting plain, twill, rip stop, or oxford.

4. The fabric of claim 1 wherein the filament yarn being inserted among the spun yarn at a ratio of 1:5 to 1:20.

* * * * *